US007308991B2

(12) United States Patent
Alberg

(10) Patent No.: US 7,308,991 B2
(45) Date of Patent: Dec. 18, 2007

(54) BLOWN BOTTLE WITH INTRINSIC LINER

(75) Inventor: Michele J. Alberg, Minnetonka, MN (US)

(73) Assignee: Advanced Technology Materials, Inc., Danbury, CT (US)

( * ) Notice: Subject to any disclaimer, the term of this patent is extended or adjusted under 35 U.S.C. 154(b) by 394 days.

(21) Appl. No.: 10/715,185

(22) Filed: Nov. 17, 2003

(65) Prior Publication Data

US 2005/0103802 A1 May 19, 2005

(51) Int. Cl.
*B65D 35/56* (2006.01)

(52) U.S. Cl. ..... 222/105; 222/1; 222/95; 222/386.5; 222/389; 156/291

(58) Field of Classification Search ..... 222/105, 222/107, 95, 183, 1, 386.5, 94, 326, 386, 222/389, 401, 387; 158/289, 291, 310
See application file for complete search history.

(56) References Cited

U.S. PATENT DOCUMENTS 3,223,289 A 12/1965 Bouet
3,592,360 A * 7/1971 Aleck ..... 222/95
3,945,539 A * 3/1976 Sossong ..... 222/386.5
4,330,066 A 5/1982 Berliner
4,350,272 A * 9/1982 Petterson ..... 222/386.5
5,060,826 A 10/1991 Coleman
5,301,838 A 4/1994 Schmidt
5,344,045 A * 9/1994 Richter et al. ..... 222/1
5,435,452 A 7/1995 Nishigami et al.
5,513,761 A 5/1996 Kobayashi et al.
5,680,966 A 10/1997 Johnson
6,083,450 A 7/2000 Safian
6,238,201 B1 5/2001 Safian
6,290,801 B1 * 9/2001 Krampe et al. ..... 156/289
6,544,459 B2 4/2003 Maruyama et al.
6,670,007 B1 * 12/2003 Safian et al. ..... 428/36.91
2002/0022099 A1 2/2002 Schmidt et al.
2002/0192466 A1 12/2002 Lu
2003/0102309 A1 6/2003 Hartwall
2003/0178445 A1 9/2003 Safian

* cited by examiner

*Primary Examiner*—Frederick C Nicolas
(74) *Attorney, Agent, or Firm*—Kinney & Lange, P.A.

(57) ABSTRACT

A container for holding and dispensing liquid having a container wall comprising a rigid portion that dimensionally defines the container, a liner portion disposed within the container adjacent to the rigid portion, and an adhesive layer disposed between the rigid portion and the liner portion. The adhesive layer removably secures the liner portion to the rigid portion such that the liner portion is capable of being separated from the rigid portion and collapsed within the container, for dispensing the liquid.

24 Claims, 8 Drawing Sheets

BLOWN BOTTLE WITH INTRINSIC LINER

BACKGROUND OF THE INVENTION

The present invention relates to a system for holding and dispensing liquids. In particular, the present invention relates to a container for holding and dispensing liquids having a collapsible liner intrinsically formed with the wall of the container.

Numerous manufacturing processes require the use of ultrapure liquids such as acids, solvents, bases, photoresists, dopants, inorganic, organic and biological solutions, pharmaceuticals, and radioactive chemicals. Such industries require that the number and size of particles in the ultrapure liquids be controlled to ensure purity. In particular, because ultrapure liquids are used in many aspects of the microelectronic manufacturing process, semiconductor manufacturers have established strict particle concentration specifications for process chemicals and chemical-handling equipment. Such specifications are needed because, should the liquids used during the manufacturing process contain high levels of particles, the particles may be deposited on solid surfaces. This can in turn lead to product failure and reduced reliability.

Accordingly, storage, transportation, and dispensing of such ultrapure liquids requires containers capable of providing adequate protection for the retained liquids. Two types of containers used in the industries are rigid-wall containers and collapsible-liner containers. Rigid-wall containers are conventionally used because of their physical strengths, thick walls, and ease of manufacture. Such containers, however, introduce air-liquid interfaces when dispensing the retained liquids by pump. This leads to unwanted particle generation in the liquids.

Alternatively, collapsible-liner containers are capable of reducing such air-liquid interfaces by collapsing the liners while dispensing. Additionally, such containers have greater recyclability, as the retained liquids only contact the collapsible liner. However, inserting liners within the containers require extra manufacturing steps after molding or casting. Moreover, because of the flexible nature of the liners, they are unable to provide adequate protection against environmental conditions. Interstitial air may become entrained between the outer wall of the container and the collapsible liner. Such interstitial air may permeate through the collapsible liner over time, contaminating the retained liquids.

Containers with collapsible liners also affect the vibrations in the retained liquids during transportation, increasing particle generation in the liquids through unwanted jostling. Such containers also may have pinholes intrinsic in the thin liners at low levels because of the manufacturing methods used, or caused by vibrations during transportation. As such, there currently exists a need in the industry for containers that combine the benefits of a rigid-wall container with the those of a collapsible-liner container.

BRIEF SUMMARY OF THE INVENTION

The present invention is a container, such as a bottle, for holding and dispensing liquids. The container has a container wall including a rigid portion dimensionally defining the container, a liner portion, and an adhesive layer disposed between the rigid portion and the liner portion. The adhesive layer removably secures the liner portion to the rigid portion such that the liner portion is capable of being separated from the rigid portion and collapsed within the container. The collapsing of the liner portion pressure dispenses the retained liquids.

In a preferred embodiment, the adhesive contact between the rigid portion and the adhesive layer has a differing bond strength than the adhesive contact between the adhesive layer and the liner portion. The differing bond strengths assist in removably securing the liner portion to the rigid portion.

In another preferred embodiment, the container wall further includes a gas inlet extending through the rigid portion to a point between the rigid portion and the liner portion for allowing gas to enter between the rigid portion and the liner portion. The gas inlet may be connected to a pressurized gas line to allow pressurized gas to remove the liner portion from the rigid portion, and collapses the liner portion within the container for pressure dispensing the retained liquids.

DETAILED DESCRIPTION

Figure 1:
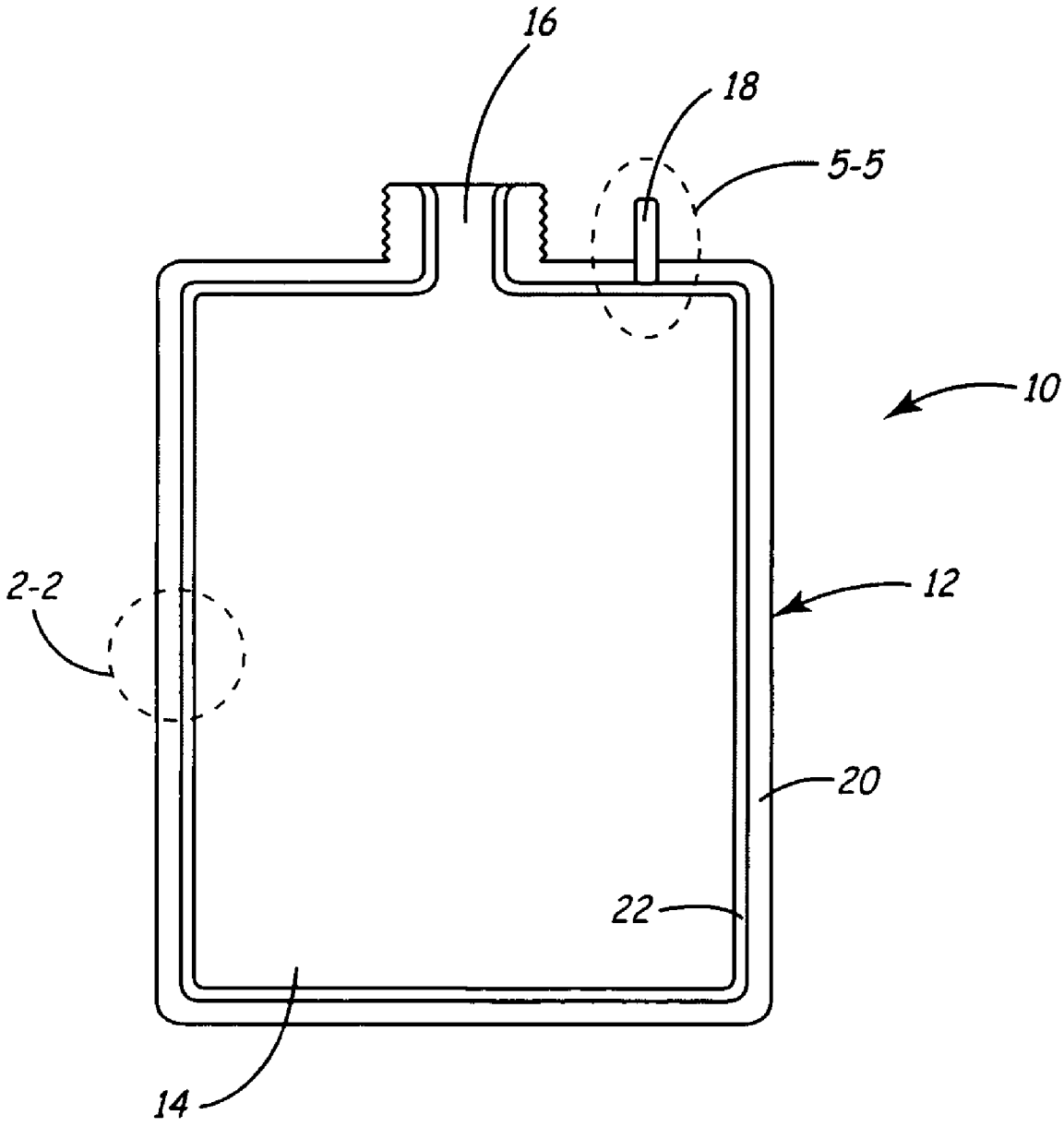
FIG. 1 is a sectional view of the present invention.

FIG. 1 is a sectional view showing a preferred embodiment of bottle 10 in accordance with the present invention. Bottle 10 is a liquid holding and dispensing container, combining the advantages of a rigid-wall container with those of a collapsible-liner container. Bottle 10 includes bottle wall 12, cavity 14, mouth 16, and gas inlet 18. Bottle wall 12 is a support structure dimensionally defining the body of bottle 10. Cavity 14 is the interior portion of bottle 10 for retaining liquid (not shown). Mouth 16 is an orifice in bottle wall 12 at the top portion of bottle 10 for filling and dispensing the retained liquids. Gas inlet 18 is a tubular protrusion extending into bottle wall 12, and is adapted to couple with a pressurized gas line (not shown) for allowing gas to flow into bottle wall 12. While illustrated as extending from the top of bottle 10, gas inlet 18 may alternatively extend from bottle wall 12 at other locations along bottle 10, such as from the sides or the bottom of bottle 10.

Bottle wall 12 includes rigid portion 20 and liner portion 22. Rigid portion 20 is an outer rigid component of bottle wall 12, dimensionally defining the body of bottle 10. Liner portion 22 is a flexible component located adjacent to, and removably secured to, the inner surface of rigid portion 20, and is the component of bottle wall 12 exposed to cavity 14.

In use, cavity 14 is filled with liquid, such as an ultrapure liquid, for storage and/or transportation. When the liquid is to be dispensed, a pressurized gas line is coupled to gas inlet 18. As illustrated, gas inlet 18 extends into bottle wall 12, through rigid portion 20, to a point between rigid portion 20 and liner portion 22. As such, as gas flows through gas inlet 18, the gas pressurizes the point between rigid portion 20 and liner portion 22, causing liner portion 22 to expand away from rigid portion 20. As the gas continues to flow, liner portion 22 continues to peel away from rigid portion 20, and collapses within cavity 14. Correspondingly, the collapsing of liner portion 22 forces the liquid to dispense from mouth 16. Dispensing the liquid in such a manner minimizes particle generation in the liquid, keeps pressurization gases from contacting the liquid, and provides control over the dispense rate. Bottle 10 is formed from an extrusion or parison blow-molding process. Polymeric materials forming rigid portion 20 and liner portion 22 are co-extruded as a tube into two block halves of a blow-mold die. The block halves are then closed leaving accessible an open portion that will become mouth 16. A blow pin is then inserted into the open portion to inflate the polymeric materials into the final dimensions of bottle 10, as designated by the closed block halves. The portion of bottle wall 12 around mouth 16 may be threaded in a conventional manner. Upon cooling, the block halves are opened, and bottle 10 is ejected and trimmed. Extrusion blow-molding processes in the art are capable of providing accurate layer thickness, acquiring rapid production rates, and molding a variety of polymeric materials.

A benefit of blow molding bottle 10 is that liner portion 22 is intrinsically formed with rigid portion 20. As such, the collapsible liner is entrained within bottle 10 upon formation. This reduces time and costs of manufacturing bottle 10 by eliminating the steps of assembling and welding a collapsible liner within the rigid bottle after molding. This also allows for bottle 10 to have the inner surface of liner portion 22 cleaned or treated in the same manners as a standard rigid-walled container, should the need arise due to special handling needs of the stored chemical. Conventional collapsible-liner containers are difficult to treat in this manner because, due to the irregular shape of the liner within the container, the cleaning chemicals are difficult to remove from the liner surface.

Upon formation of bottle 10, liner portion 22 is removably secured to rigid portion 20 at every point along bottle wall 12, except at mouth 16. At the location around mouth 16, liner portion 22 is non-removably secured to rigid portion 20. This prevents liner portion 22 from peeling away from rigid portion 20 around mouth 16 during a dispensing process. If liner portion 22 were to peel from rigid portion 20 at mouth 16, liner portion 22 would fall to the bottom of bottle 10, preventing further pressurized dispensing of the retained liquid.

Liner portion 22 may be non-removably secured to rigid portion 20 around mouth 16 in a variety of manners. For example, during the blow molding process, a ringed brace may be inserted around mouth 16 prior to cooling. Due to the shrinking of the polymeric materials while cooling and solidifying, the portion of bottle wall 12 around mouth 16 shrinks around the ringed brace, wedging the ringed brace in place around mouth 16. The ringed brace then prevents liner portion 22 from removing from rigid portion 20 around mouth 16. Alternatively, an additional adhesive may be applied between rigid portion 20 and liner portion 22 at mouth 16 to securely hold liner portion 22. Another alternative includes a storage and dispensing cap designed to brace liner portion 22 to rigid portion 20 at mouth 16. When the given cap is screwed onto bottle 10, a portion of the cap extends into mouth 16 to act as a brace, preventing the removal of liner portion 22 around mouth 16.

Gas inlet 18 may also be formed in a variety of manners. Preferably, gas inlet 18 is formed as an extension of the polymer materials of bottle wall 12. This is accomplished by machining the extension dimensions into the cavities of the block halves of the blow-mold die. A slide assembly pin then inserts a hole into the molded extension as the material cools. Alternatively, a hole may be inserted into bottle wall 12 where gas inlet 18 is to be located, and a separate tubular extension is inserted and secured to bottle wall 12. In either case, gas inlet 18 preferably includes a threaded or coupling end for connecting to a pressurized gas line. Dimensionally, the outer diameter of gas inlet 18 may vary as aesthetically or spatially required. However, the preferred inner diameter of gas inlet 18 ranges from 0.0625 inches (1.588 millimeters) to 0.25 inches (6.35 millimeters), providing for a reasonable gas flow rate to collapse liner portion 22.

After molding, bottle 10 may also be cleaned and/or treated to meet specific customer needs, just as if bottle 10 were a rigid-walled container. Accordingly, by intrinsically forming rigid portion 20 and liner portion 22 such that liner portion 22 is removably secured to rigid portion 20, bottle 10 combines the advantages of a rigid container, such as structural support, and gas/moisture barriers, with the advantages of a collapsible-liner container, such as pressurized liquid dispensing and greater recycling abilities.

Figure 2:
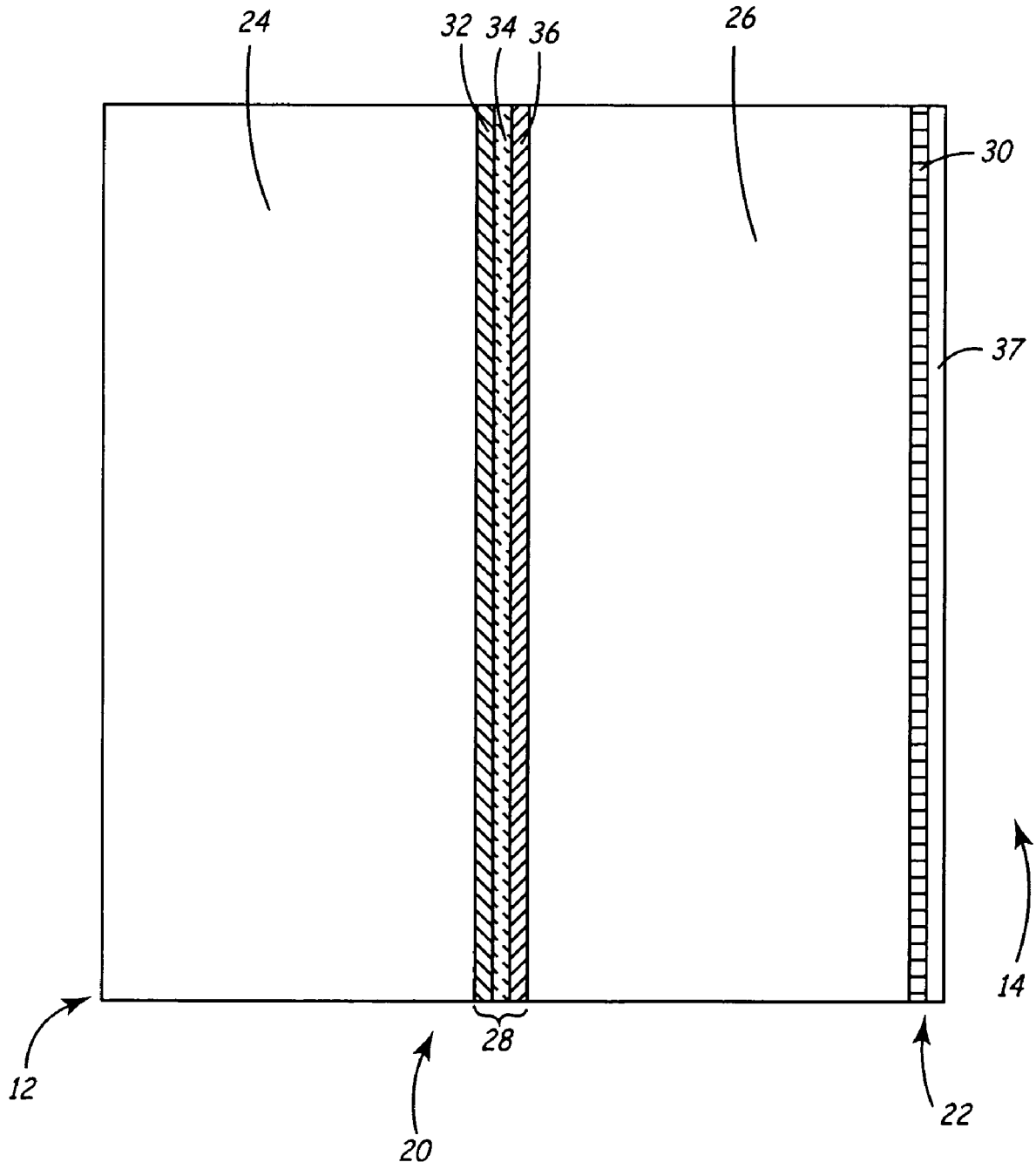
FIG. 2 is an expanded view of section 2-2 in FIG. 1.

FIG. 2 is an expanded view of section 2-2 in FIG. 1 illustrating the cross-sectional layers of rigid portion 20 and liner portion 22. As shown, rigid portion 20 includes outer and inner rigid layers 24,26, and barrier layers 28. Outer rigid layer 24 is the layer of rigid portion 20 and bottle wall 12 exposed to the outside environment, providing mechanical support to bottle wall 12. Outer rigid layer 24 is preferably about 0.055 inches (1.40 millimeters) in thickness, and preferably consists of a high density polyethylene, but may also be a polycarbonate, polyethylene terephthalate, polyacrylonitrile, or other blow-moldable material of comparable physical properties. Outer rigid layer 24 may also contain color dyes so that the external surface of bottle 10 may have customized colorings. This provides added commercial flexibility by allowing customers to identify different stored liquids with different-colored containers.

Inner rigid layer 26 is an inner layer of rigid portion 20, also providing mechanical support to bottle wall 12. Inner rigid layer 26 is also preferably about 0.055 inches (1.40 millimeters) in thickness, and generally may be molded from the same materials as outer rigid layer 24. As discussed below, however, the particular material used for inner rigid layer 26 will affect the interactions of rigid portion 20 and liner portion 22.

Barrier layers 28 are disposed between outer rigid layer 24 and inner rigid layer 26, and provide physical barriers from external environmental conditions. Such barriers are important to minimize exposing the contained liquids. As illustrated, barrier layers 28 include light reduction layer 32, moisture permeation reduction layer 34, and gas permeation reduction layer 36, wherein preferably each layer is about 0.002 inches (0.051 millimeters) in thickness. Additionally, adhesive tie layers (not shown), each being about 0.001 inches (0.025 millimeters) in thickness, exist between each layer, securely adhering outer rigid layer 24, light reduction layer 32, moisture permeation reduction layer 34, gas permeation reduction layer 36, and inner rigid layer 26 together.

Light reduction layer 32 is a barrier for reducing penetration of ultraviolet and visible light, and may consist of a chemical based light-blocking agent, such as carbon black, added to a polymer, such as nylon. It is beneficial to have light reduction layer 32 as the outermost layer of barrier layers 28 to prevent exposing the inner layers to light. Ultraviolet and visible light are known to degrade polymers over time, rendering them brittle. As such, light reduction layer 32 protects the inner-most layers of rigid portion 20 and liner portion 22. Additionally, and more importantly, light reduction layer 32 also prevents exposing liquid contained within cavity 14 to such light, as many liquids contained may be light sensitive.

Moisture and gas permeation reduction layers 34, 36 are used to prevent external moisture and gases from reaching the contained liquid, preventing contamination. Each of moisture and gas permeation reduction layers 34, 36 are preferably a nanocomposite, such as a nanoclay, compounded with materials such as nylon. The preferred compositions include the Aegis™ Nanocomposite Barrier Resin from Honeywell International, Inc., and Nanomerg from Nanocor, Inc. These compositions function as webs, which entrap diffused moisture and gas, preventing further permeation. Nanocomposites are also preferred as they enhance the physical strength and resistance of rigid portion 20. Alternatively, moisture and gas permeation reduction layers 34, 36 may be derived from ethylene vinyl alcohol, or other blow-moldable materials having moisture and gas permeation reduction capabilities.

Describing barrier layers 28 as having light reduction layer 32, moisture permeation reduction layer 34, and gas permeation reduction layer 36 is illustrative of the potential layers encompassed in bottle 10. Barrier layers 28 may alternatively include fewer layers or additional layers, as required by a particular industry. For example, light reduction layer 32, moisture permeation reduction layer 34, and gas permeation reduction layer 36 may be formed in as few as one or two layers. A decrease to two layers may be accomplished by using a single layer that replaces moisture and gas permeation reduction layers 34, 36, as both of these layers preferably consist of the same compounds. Moreover, the need for light reduction layer 32 being a separate layer may be precluded by adding the chemical based light-blocking agent of light reduction layer 32 to the other layers. Preferably, chemical based light-blocking agents such as carbon black would be added to one or more layers in barrier layers 28, and not to outer rigid layer 24. Carbon black reduces the aesthetic qualities of outer surfaces, including luster reduction.

If the number of layers within barrier layers 28 are reduced, it is preferable that outer rigid layer 24 is increased in thickness by the same amount that barrier layers 28 are reduced. For example, if moisture and gas permeation reduction layers 34, 36 are reduced to a single layer, barrier layers 28 are reduced by about 0.003 inches (0.076 millimeters) in thickness (0.002 inches (0.051 millimeters) for removal of one of the layers and 0.001 inches (0.025 millimeters) for removal of the extra tie layer). As such, outer rigid layer 24 should correspondingly be increased by about 0.003 inches (0.076 millimeters), to a preferred thickness of about 0.058 inches (1.47 millimeters). The purpose of this correction is to ensure that rigid portion 20 retains a physically sturdy structure, resistant to deformation and damage.

An example of an additional barrier layer that may be incorporated is the Barex® Resins from BP p.l.c., which are oxygen barrier resins, and may be blow molded along with other layers of barrier layers 28. Another example is the Vitex Barix™ Coating from Vitex Systems, Inc., which may be vacuum deposited to a thickness of about two microns onto the external surface of outer rigid layer 24 (i.e., on the surface of bottle 10) subsequent to the blow molding process. The Vitex Barix™ Coating is known as a superior permeation reduction barrier against moisture and gas.

Tie layer 30 is an adhesive layer disposed adjacent to inner rigid layer 26 and is preferably an anhydride modified linear low density polyethylene, polypropylene, or polypropylene. As discussed below, tie layer 30 may be a component of rigid portion 20 or liner portion 22 depending upon the composition of inner rigid layer 26. As such, in a first embodiment of the present invention, tie layer 30 constitutes a component of rigid portion 20 and remains secured to inner rigid layer 26 when liner portion 22 peels away from rigid portion 20. Alternatively, in a second embodiment, tie layer 30 constitutes a component of liner portion 22 and detaches from inner rigid layer 26 when liner portion 22 peels away from rigid portion 20.

Liner portion 22 includes high-purity layer 37 (and tie layer 30 in the second embodiment). High-purity layer 37 is preferably a high-purity, high density polyethylene, and is the portion of bottle wall 12 that is exposed to cavity 14. High-purity layer 37 may alternatively consist of a high-purity, medium density polyethylene. Both polymers allow high-purity layer 37 to remain flexible enough to collapse within cavity 14. A high purity polymer is necessary for preventing contamination of ultrapure liquids retained in cavity 14.

As previously discussed, liner portion 22 is intrinsically formed with rigid portion 20 and tie layer 30 through the blow-molding process. This adds the benefit of preventing interstitial air from existing adjacent to liner portion 22. Typically, with collapsible-liner containers, interstitial air resides between the liner and the outer rigid wall. This presents a potential problem of the air permeating into the contained liquid over time, contaminating the liquid. Because the liner must remain flexible, it is difficult to include an adequate gas permeation reduction layer along with the liner, while retaining enough flexibility to allow the liner to collapse. By having liner portion 22 intrinsically formed with rigid portion 20, interstitial air is essentially non-existent between the layers. As such, liner portion 22 retains the flexibility to collapse, while also being protected from external conditions through barrier layers 28.

Figure 3:
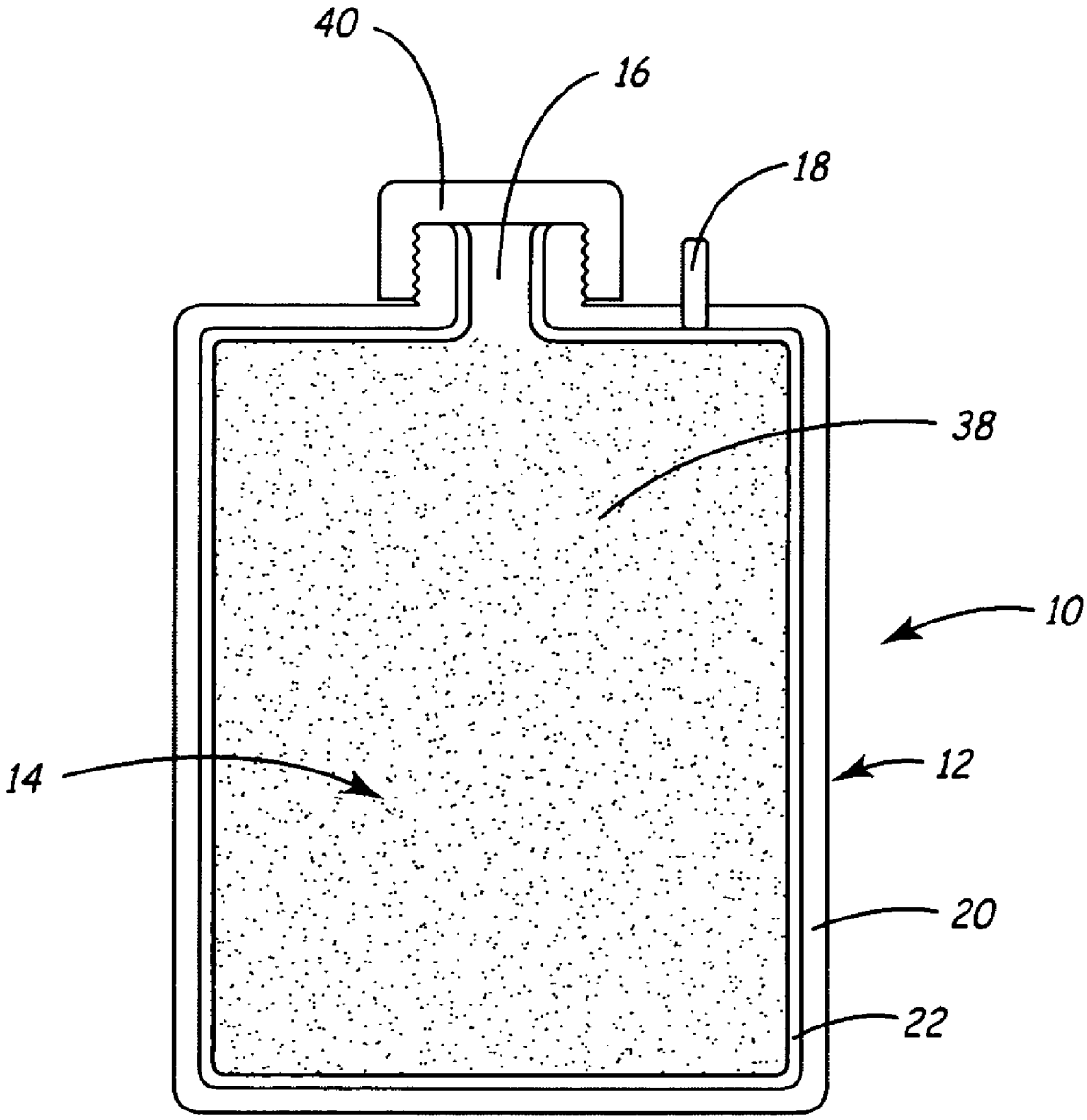
FIG. 3 is a sectional view of the present invention in use.
Figures 4A, 4B, 4C:
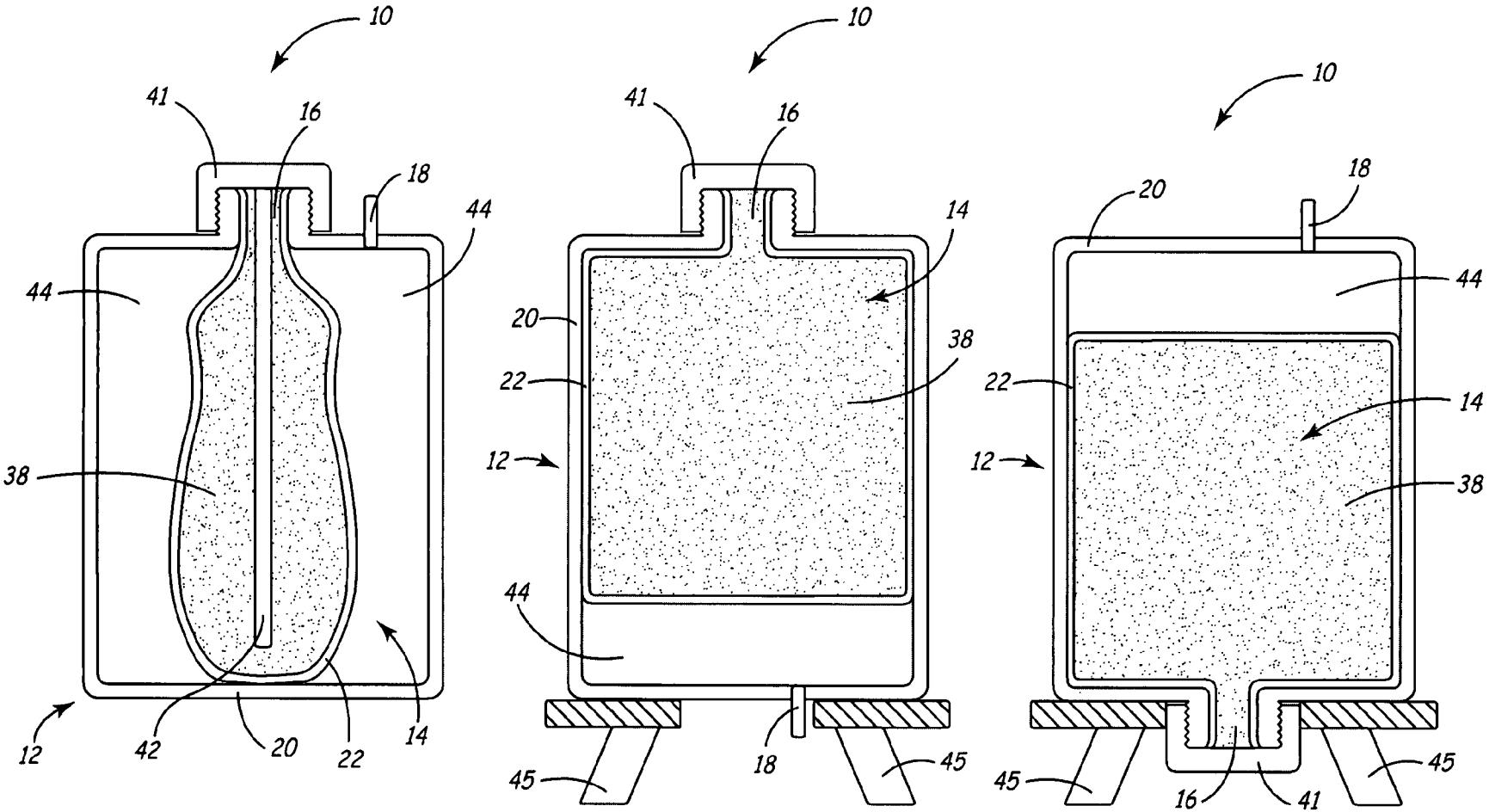
FIG. 4*a* is a sectional view of the present invention in use during a dispensing process.
FIG. 4*b* is a sectional view of the present invention, illustrating an alternative dispensing process.
FIG. 4*c* is a sectional view of the present invention, illustrating an alternative dispensing process.

FIGS. 3 and 4*a* are sectional views of bottle 10, as described in FIGS. 1 and 2, in use. FIG. 3 shows cavity 14 filled with liquid 38, and closed off with cap 40. Liquid 38 is preferably an ultrapure liquid, and may be filled into bottle 10 in the same manner as with a conventional bottle. Because liner portion 22 is intrinsically formed with, and removably secured to rigid portion 20, liquid 38 may completely fill cavity 14 without the concern of interstitial air being retained along liner portion 22.

In addition to ultrapure liquids used in manufacturing, liquid 38 may consist of a wide variety of liquids. As such, bottle 10 of the present invention is additionally useful for storing, transporting, and dispensing liquids used in many different industries, including medical, sanitation, and beverage industries.

The level of filling of cavity 14 may be varied as required. For example, as illustrated in FIG. 3, liquid 38 is filled such that there is a headspace at mouth 16. It may be preferable to leave a headspace for liquids that expand with small changes in temperature or are volatile. Alternatively, the liquid level may extend into mouth 16, eliminating the headspace. This provides the advantage of reducing air-liquid interfaces, which can potentially increase particle generation in the liquids during transportation.

After filling, cap 40 is screwed onto bottle 10 around mouth 16 for a secure seal. Cap 40 may be a conventional cap, or as previously mentioned, cap 40 may be designed to brace liner portion 22 to rigid portion 20 at mouth 16, preventing the removal of liner 22 around mouth 16. Upon being sealed with cap 40, bottle 10 is ready for storage and/or transportation before dispensing.

FIG. 4*a* illustrates bottle 10 as liquid 38 is dispensed, and further includes dispense cap 41, dispense tube 42, and area 44. Dispense cap 41 and dispense tube 42 are optional components that assist in dispensing liquid 38. When dispensing liquid 38, dispense tube 42 is inserted into cavity 14, and cap 40 is replaced with dispense cap 41. Dispense cap 41 provides a seal fit around mouth 16 and dispense tube 42 for allowing a pressurized dispensing of liquid 38. Alternatively, as previously mentioned, dispense cap 41 may be designed to brace liner portion 22 to rigid portion 20 at mouth 16, preventing the removal of liner 22 around mouth 16.

The dispensing process begins with connecting gas inlet 18 to a pressurized gas line (not shown). Preferably, the pressurized gas line will provide a gas, such as clean dry air or nitrogen. When the pressurized gas line is securely connected, gas is allowed to flow through gas inlet 18 under a moderate pressure such as about 5 psi (34.5 kPa), pressurizing the point between rigid portion 20 and liner portion 22. This forces liner portion 22 to separate from rigid portion 20 and collapse within cavity 14. The collapsing of liner portion 22 forms area 44, which is filled with the pressurizing gas, and forces liquid 38 to dispense through dispense tube 42.

The pressurizing may continue until liquid 38 is fully dispensed, signified by the complete collapse of liner portion 22 (except from the portion of liner portion 22 non-removably secured to rigid portion 20 around mouth 16). The point at which liner portion 22 is completely collapsed is determinable in a variety of conventional manners, such as by pressure gauging or timed dispensing. Dispensing is discontinued by closing off the pressurized gas line, preventing further gas from entering through gas inlet 18.

Alternative means for dispensing liquid 38 may also be used. For example, bottle 10 may be placed within a pressurizing system, where gas inlet 18 is left exposed to the external environment of the pressurizing system. In such case, the pressurizing system increases pressure around bottle 10. Because gas inlet 18 is exposed to the external environment, the increase in external pressure collapses liner portion 22 in a similar manner to a pressurized gas line. The structural support of rigid portion 20, however, prevents the exterior dimensions of bottle wall 12 from deforming under the pressure.

Another alternative for dispensing liquid 38 is with the use of a pumping mechanism (not shown) connected to dispense tube 42. In this alternative, gas inlet 18 is left exposed to the atmosphere. The pumping mechanism pumps liquid 38 through dispense tube 42 causing a negative pressure from the inner surface of liner portion 22. This pulls liner portion 22 from rigid portion 20, collapsing liner portion 22 around liquid 38. As liner portion 22 collapses, air is sucked into area 44 through gas inlet 18 to fill the void. The benefit of this alternative is that liquid 38 is pumped from cavity 14 with minimal air-liquid interfacing, reducing unwanted particle generation in ultrapure liquids.

FIG. 4*b* is a sectional view of bottle 10, as described in FIGS. 1-3 and 4*a*, illustrating a third alternative for dispensing liquid 38. In this alternative, gas inlet 18 is positioned at the bottom of bottle 10, instead of the top, where it is connected to a pressurized gas line (not shown). In such case, bottle 10 is supported on stand 45, which is a conventional stand, allowing access to gas inlet 18 on the bottom of bottle 10. As gas is filled through gas inlet 18, liner portion 22 is separated from rigid portion 20, starting at the bottom of bottle 10. This provides the benefit of collapsing liner portion 22 from the bottom in an upward direction, ensuring that the entire content of liquid 38 is dispensed. Preferably, dispense tube 42 is not used in this alternative, as it may hinder the upward collapsing of liner portion 22.

FIG. 4*c* is another sectional view of bottle 10, as described in FIGS. 1-3 and 4*a*, illustrating a fourth alternative for dispensing liquid 38. Similar to the third alternative shown in FIG. 4*b*, gas inlet 18 is again positioned at the bottom of bottle 10. However, in this alternative, bottle 10 is inverted and supported on stand 45 so that mouth 16 is located vertically under bottle 10, and gas inlet 18 is located vertically above bottle 10. Liquid 38 is then dispensed under the force of gravity. Accordingly, cap 41 and mouth 16 are connected to a dispense line (not shown) that regulates the flow of liquid 38 out of bottle 10. Similar to the pumping alternative, liner portion 22 is collapsed under the negative pressure caused by liquid 38 dispensing, and gas inlet 18 is again exposed to the atmosphere for filling area 44 with air. This alternative also provides the benefit of minimizing air-liquid interfaces for reducing particle generation in liquid 38.

As illustrated by the various alternative for dispensing liquid 38, bottle 10 is a versatile system that is adaptable to a variety of industrial dispensing requirements.

Figure 5:
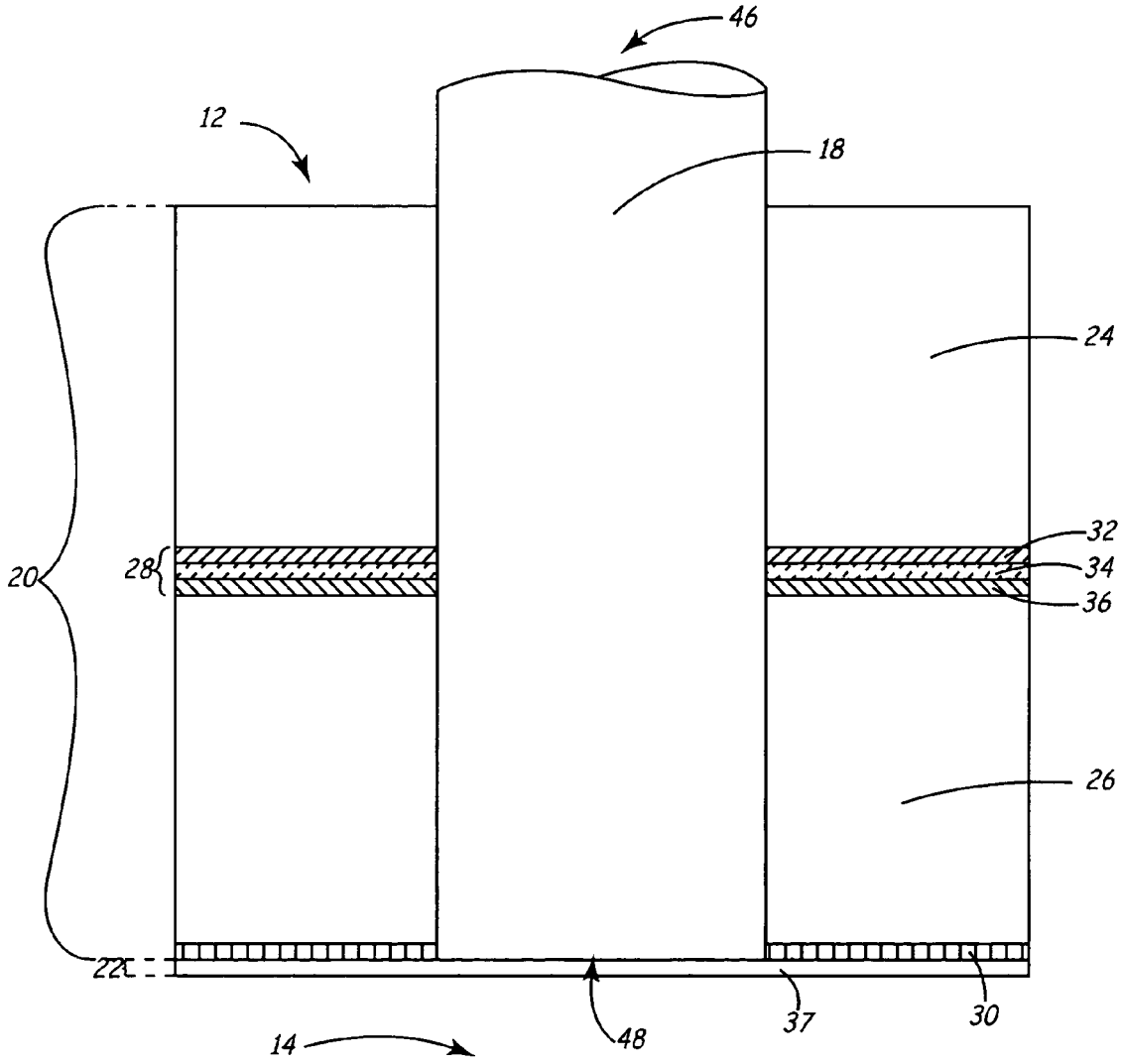
FIG. 5 is an expanded view of section 5-5 in FIG. 1, illustrating the first embodiment of the present invention.
Figure 6:
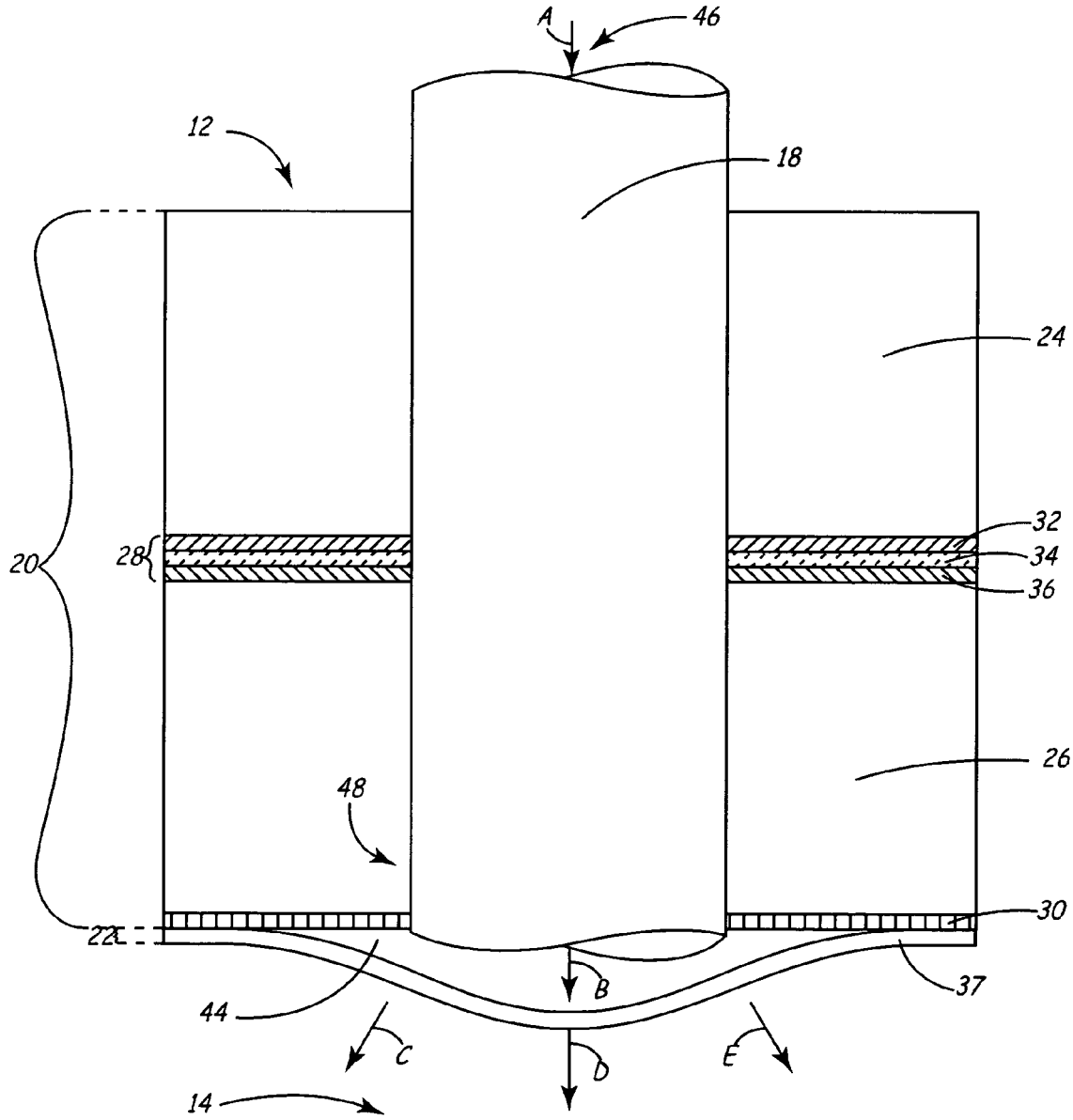
FIG. 6 is an expanded view of section 5-5 in FIG. 1, illustrating the first embodiment of the present invention in use during a dispensing process.

FIGS. 5 and 6 are expanded views of section 5-5 in FIG. 1 showing the first embodiment of the present invention, wherein tie layer 30 constitutes a component of rigid portion 20. FIGS. 5 and 6 include rigid portion 20 and liner portion 22, as described in FIG. 2, and further include gas inlet 18. Gas inlet 18 includes external end 46 extending out of bottle wall 12, and internal end 48 extending into bottle wall 12. As defined in the first embodiment, rigid portion 20 includes outer and inner rigid layers 24, 26, barrier layers 28, and tie layer 30. Correspondingly, liner portion 22 includes only high-purity layer 37.

Referring to FIG. 5, pursuant to the first embodiment, inner rigid layer 26 is molded from materials such as polycarbonate, polyethylene terephthalate, and polyacrylonitrile, but not from high density polyethylene. This is due to the greater adhesive characteristics of polycarbonate, polyethylene terephthalate, and polyacrylonitrile with tie layer 30, compared to high density polyethylene. It is also preferable in this first embodiment that tie layer 30 consist of an anhydride modified polypropylene or an anhydride modified ethylene vinyl alcohol. As such, the adhesive contact between inner rigid layer 26 and tie layer 30 has a greater adhesive bond strength than the adhesive contact between tie layer 30 and high-purity layer 37 (consisting of a high-purity, high or medium density polyethylene).

Preferably, the adhesive bond strength between inner rigid layer 26 and tie layer 30 is at least two times greater than the adhesive bond strength between tie layer 30 and high-purity layer 37. More preferably, the adhesive bond strength between inner rigid layer 26 and tie layer 30 is at least five times greater than the adhesive bond strength between tie layer 30 and high-purity layer 37. Even more preferably, the adhesive bond strength between inner rigid layer 26 and tie layer 30 is at least nine times greater than the adhesive bond strength between tie layer 30 and high-purity layer 37.

When pressurizing gas flows through gas inlet 18, tie layer 30 remains secured to inner rigid layer 26 (i.e., as a component of rigid portion 20), and high-purity layer 37 will peel away from tie layer 30 (i.e., as liner portion 22) due to the differences in adhesive bond strengths. The purpose of having an adhesive layer, such as tie layer 30, is so that high-purity layer 37 does not peel off prior to dispensing. Thus, it is beneficial to have a level of adhesiveness between rigid portion 20 and liner portion 22 to prevent premature removal of liner portion 22. This is especially true for larger sized bottles 10, such as four or ten liter capacities, which have larger surface areas.

Additionally, in the first embodiment, gas inlet 18 is molded such that internal end 48 is positioned at a point between tie layer 30 and high-purity layer 37. This allows gas from the pressurized gas line (not shown) to flow between tie layer 30 and high-purity layer 37. Referring to FIG. 6, gas flows from the pressurized gas line (not shown) into external end 46 of gas inlet 18, designated by arrow A, and out through internal end 48, designated by arrow B. Because internal end 48 is positioned between tie layer 30 and high-purity layer 37, pressure increases between these layers, forcing high-purity layer 37 to peel away from tie layer 30, as designated by arrows C, D, and E, and collapse within cavity 14. The collapsing of high-purity layer 37 then pressure dispenses liquid 38 from cavity 14.

Accordingly, the first embodiment of the present invention combines the use of an adhesive contact having a weaker adhesive bond strength between rigid portion 20 and liner portion 22, with the placement of internal end 48 of gas inlet 18 at the adhesive contact with the weaker adhesive bond strength. This combination allows liner portion 22 to be secured to rigid portion 20 and readily removable when required.

Figure 7:
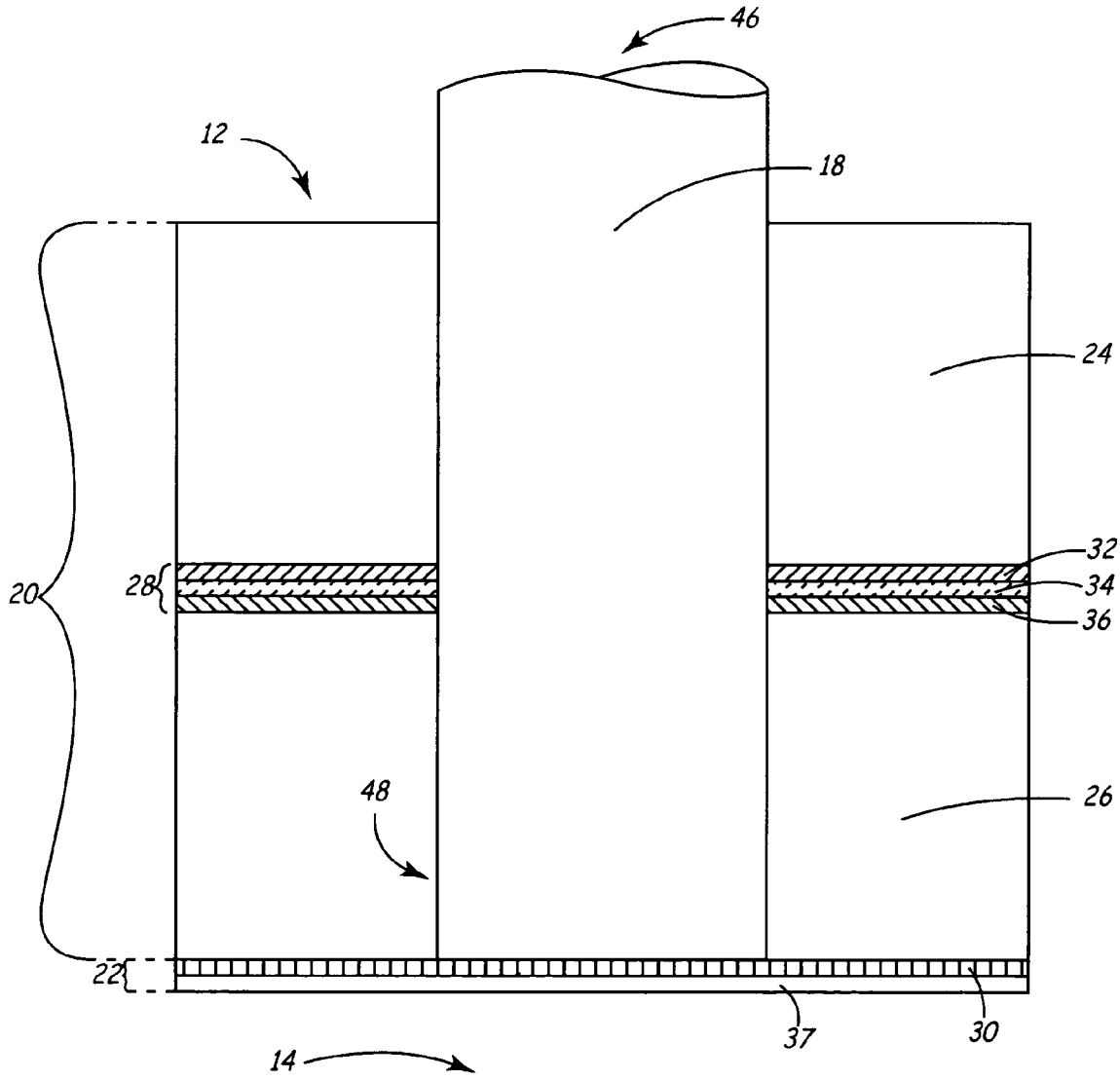
FIG. 7 is an expanded view of section 5-5 in FIG. 1, illustrating a second embodiment of the present invention.
Figure 8:
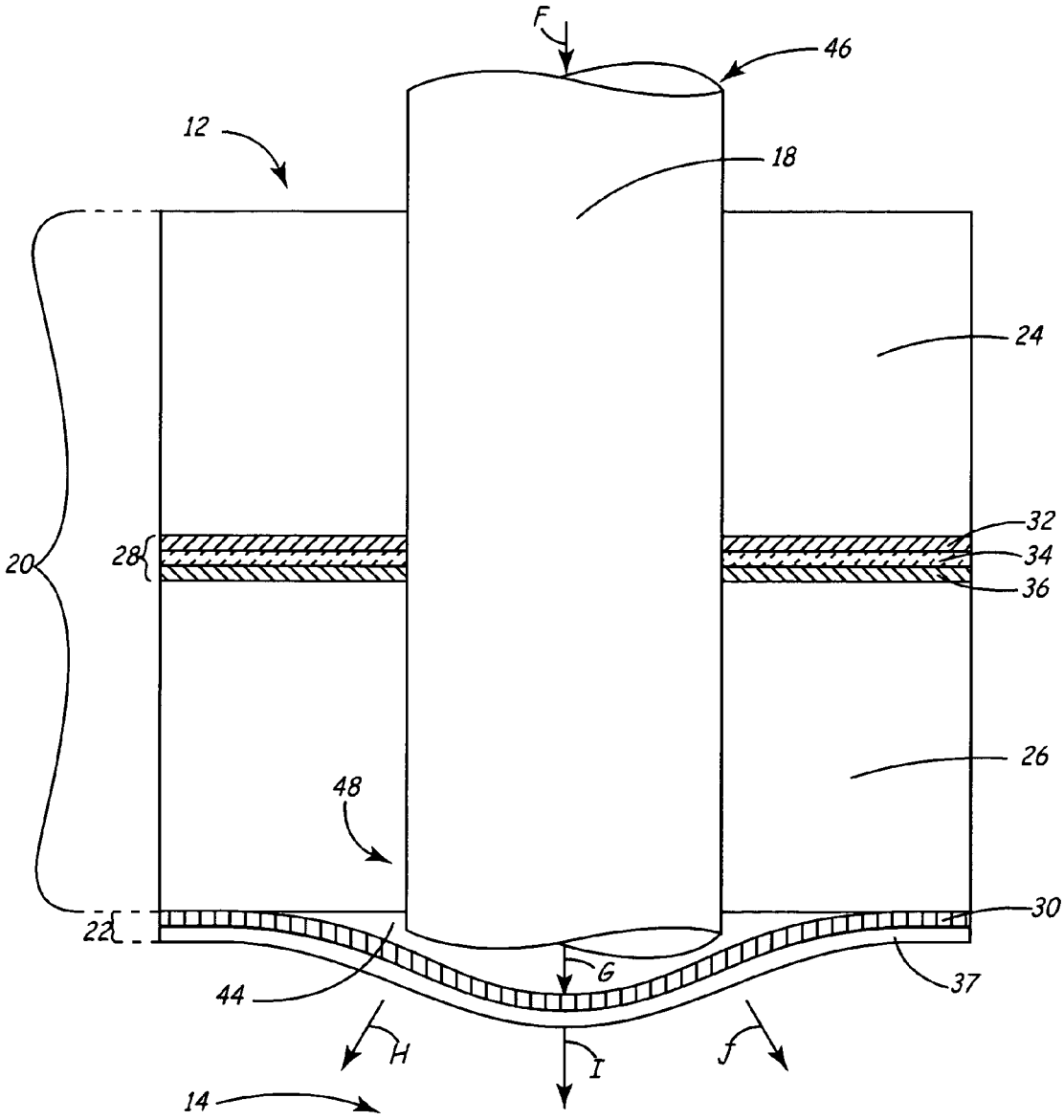
FIG. 8 is an expanded view of section 5-5 in FIG. 1, illustrating the second embodiment of the present invention in use during a dispensing process.

FIGS. 7 and 8 are also expanded views of section 5-5 in FIG. 1 describing the second embodiment of the present invention, wherein tie layer 30 constitutes a component of liner portion 22. FIGS. 7 and 8 include rigid portion 20 and liner portion 22, as described in FIG. 2, and further include gas inlet 18. Gas inlet 18 includes external end 46 extending out of bottle wall 12, and internal end 48 extending into bottle wall 12. As defined in the second embodiment, rigid portion 20 includes outer and inner rigid layers 24, 26, and barrier layers 28. Correspondingly, liner portion 22 includes tie layer 30 and high-purity layer 37.

Referring to FIG. 7, pursuant to the second embodiment, inner rigid layer 26 is molded from materials such as high density polyethylene, but not from polycarbonate, polyethylene terephthalate, or polyacrylonitrile. Despite the latter materials having greater adhesive properties, high density polyethylene provides greater physical strengths for rigid portion 20. However, when high density polyethylene is used for inner rigid layer 26, the adhesive contact between inner rigid layer 26 and tie layer 30 has an equal adhesive bond strength to the adhesive contact between tie layer 30 and high-purity layer 37. This is because inner rigid layer 26 and high-purity layer 37 both consist of high density polyethylene. Therefore, the high density polyethylene compound of inner rigid layer 26 is also doped with an adhesive-reducing compound, such as Teflon or siloxane, so that the adhesive contact between tie layer 30 and high-purity liner 37 has a greater adhesive bond strength than the adhesive contact between inner rigid layer 37 and tie layer 30.

It is also preferable in this second embodiment that tie layer 30 consist of an anhydride modified linear low density polyethylene. Because high-purity layer 37 must remain a high purity polymer to prevent contamination of liquid 38, it is undesirable to dope high-purity layer 37.

Preferably, the adhesive bond strength between tie layer 30 and high-purity liner 37 is at least two times greater than the adhesive bond strength between inner rigid layer 37 and tie layer 30. More preferably, the adhesive bond strength between tie layer 30 and high-purity liner 37 is at least five times greater than the adhesive bond strength between inner rigid layer 37 and tie layer 30. Even more preferably, the adhesive bond strength between tie layer 30 and high-purity liner 37 is at least nine times greater than the adhesive bond strength between inner rigid layer 37 and tie layer 30.

When pressurizing gas flows through gas inlet 18, tie layer 30 will peel away from inner rigid layer 26 and remain secured to high-purity layer 37 (i.e., as a component of liner portion 22) due to the differences in adhesive bond strengths. As with the first embodiment, a level of adhesion between tie layer 30 and inner rigid layer 26 is beneficial to removably secure liner portion 22 with rigid wall 20, so as to prevent premature peeling.

Another distinction between the first and second embodiments is that, in the second embodiment, gas inlet 18 is molded such that internal end 48 is positioned at a point between inner rigid layer 26 and tie layer 30, rather than between tie layer 30 and high-purity layer 37. This allows gas from the pressurized gas line (not shown) to flow between inner rigid layer 26 and tie layer 30. Referring to FIG. 8, gas flows from the pressurized gas line (not shown) into external end 46 of gas inlet 18, designated by arrow F, and out through internal end 48, designated by arrow G. Because internal end 48 is positioned between inner rigid layer 26 and tie layer 30, pressure increases between these layers, forcing tie layer 30 and high-purity layer 37 to peel away from inner rigid layer 26, as designated by arrows H, I, and J, and collapse within cavity 14. As such, in the second embodiment, liner portion 22 includes tie layer 30 and high-purity layer 37. The collapsing of liner portion 22 then pressure dispenses liquid 38 from cavity 14.

As shown in FIGS. 7 and 8, the second embodiment also combines the use of an adhesive contact having a weaker adhesive bond strength between rigid portion 20 and liner portion 22, with the placement of internal end 48 of gas inlet 18 at the adhesive contact with the weaker adhesive bond strength. This combination also allows liner portion 22 to be secured to rigid portion 20 and readily removable when required.

As illustrated in the first and second embodiments, bottle 10 may be molded from a variety of polymers having different adhesive qualities, while retaining the benefits of having liner portion 22 intrinsically formed with rigid portion 20. These benefits allow bottle 10 to combine the advantages of a rigid-wall container with the advantages of a collapsible-liner container. Although the present invention has been described with reference to preferred embodiments, workers skilled in the art will recognize that changes may be made in form and detail without departing from the spirit and scope of the invention.

The invention claimed is:

1. A container for holding and dispensing liquid, comprising:

a container mouth;

a container body extending from the container mouth, comprising:

a rigid portion dimensionally defining the container body;

a liner portion disposed within the container adjacent to the rigid portion, and adapted to collapse within the container for dispensing the liquid through the container mouth; and an adhesive layer disposed between the rigid portion and the liner portion for removably securing the liner portion to the rigid portion, wherein the adhesive layer has a first adhesive contact with the rigid portion and a second adhesive contact with the liner portion, the first adhesive contact and the second adhesive contact have differing adhesive bond strengths, and the adhesive bond strength of the first adhesive contact is greater than the adhesive bond strength of the second adhesive contact.

2. The container of claim 1 further comprising a gas inlet extending through the rigid portion to a point between the rigid portion and the liner portion for allowing gas to enter between the rigid portion and the liner portion.

3. The container of claim 1, wherein the rigid portion, the adhesive layer, and the liner portion are intrinsically formed together through a blow-molding process.

4. The container of claim 1, wherein the rigid portion comprises at least one barrier layer for reducing permeation of gas.

5. The container of claim 1, wherein the rigid portion comprises at least one barrier layer for reducing permeation of moisture.

6. The container of claim 1, wherein the rigid portion comprises at least one barrier layer for reducing penetration of ultraviolet and visible light.

7. A rigid container for liquid, characterized by a container wall comprising:

a rigid portion dimensionally defining the rigid container;

a liner portion disposed within the rigid container adjacent to the rigid portion; and an adhesive layer disposed between the rigid portion and the liner portion and having a first adhesive contact with the rigid portion and a second adhesive contact with the liner portion, wherein the first adhesive contact and the second adhesive contact have differing adhesive bond strengths and the adhesive layer removably secures the liner portion to the rigid portion such that the liner portion is capable of being separated from the rigid portion and collapsed within the rigid container, the liner portion is configured to dispense the liquid from the rigid container while pressurized gas from an external source is introduced between the rigid portion and the liner portion, and the adhesive bond strength of the first adhesive contact is greater than the adhesive bond strength of the second adhesive contact.

8. The container wall of claim 7 further comprising a gas inlet extending through the rigid portion to a point between the rigid portion and the liner portion for allowing gas to enter between the rigid portion and the liner portion.

9. The container of claim 7, wherein the rigid portion comprises at least one barrier layer for reducing permeation of gas.

10. The container of claim 7, wherein the rigid portion comprises at least one barrier layer for reducing permeation of moisture.

11. The container of claim 7, wherein the rigid portion comprises at least one barrier layer for reducing penetration of ultraviolet and visible light.

12. A method of dispensing liquid from a container comprising:

providing a container retaining the liquid, comprising:

a container mouth;

a container body extending from the container mouth, comprising:

an exterior rigid portion;

an interior liner portion disposed adjacent to the exterior rigid portion; and an adhesive layer disposed between the exterior rigid portion and the interior liner portion and having a first adhesive contact with the rigid portion and a second adhesive contact with the liner portion, wherein the adhesive layer removably secures the liner portion to the rigid portion and the first adhesive contact and the second adhesive contact have differing adhesive bond strengths, and the adhesive bond strength of the first adhesive contact is greater than the adhesive bond strength of the second adhesive contact; and introducing pressurized gas from an external source between the interior liner portion and the exterior rigid portion, wherein the interior liner portion separates from the exterior rigid portion to collapse within the container and dispense the liquid through the container mouth while the pressurized gas is introduced from the external source.

13. A method of dispensing liquid from a container comprising:

providing a container retaining the liquid, comprising:

a container mouth;

a container body extending from the container mouth, comprising:

an exterior rigid portion;

an interior liner portion disposed adjacent to the exterior rigid portion; and an adhesive layer disposed between the exterior rigid portion and the interior liner portion and having a first adhesive contact with the rigid portion and a second adhesive contact with the liner portion, wherein the adhesive layer removably secures the liner portion to the rigid portion and the first adhesive contact and the second adhesive contact have differing adhesive bond strengths, and the adhesive bond strength of the first adhesive contact is less than the adhesive bond strength of the second adhesive contact; and introducing pressurized gas from an external source between the interior liner portion and the exterior rigid portion, wherein the interior liner portion separates from the exterior rigid portion to collapse within the container and dispense the liquid through the container mouth while the pressurized gas is introduced from the external source.

14. A container for holding and dispensing liquid, comprising:

a container mouth;

a container body extending from the container mouth, comprising:

a rigid portion dimensionally defining the container body;

a liner portion disposed within the container adjacent to the rigid portion, and adapted to collapse within the container for dispensing the liquid through the container mouth; and an adhesive layer disposed between the rigid portion and the liner portion for removably securing the liner portion to the rigid portion, wherein the adhesive layer has a first adhesive contact with the rigid portion and a second adhesive contact with the liner portion, the first adhesive contact and the second adhesive contact have differing adhesive bond strengths, and the adhesive bond strength of the first adhesive contact is less than the adhesive bond strength of the second adhesive contact.

15. The container of claim 14 further comprising a gas inlet extending through the rigid portion to a point between the rigid portion and the liner portion for allowing gas to enter between the rigid portion and the liner portion.

16. The container of claim 14, wherein the rigid portion, the adhesive portion, and the liner portion are intrinsically formed together through a blow-molding process.

17. The container of claim 14, wherein the rigid portion comprises at least one barrier layer for reducing permeation of gas.

18. The container of claim 14, wherein the rigid portion comprises at least one barrier layer for reducing permeation of moisture.

19. The container of claim 14, wherein the rigid portion comprises at least one barrier layer for reducing penetration of ultraviolet and visible light.

20. A rigid container for liquid, characterized by a container wall comprising:

a rigid portion dimensionally defining the rigid container;

a liner portion disposed within the rigid container adjacent to the rigid portion; and an adhesive layer disposed between the rigid portion and the liner portion and having a first adhesive contact with the rigid portion and a second adhesive contact with the liner portion, wherein the first adhesive contact and the second adhesive contact have differing adhesive bond strengths and the adhesive layer removably secures the liner portion to the rigid portion such that the liner portion is capable of being separated from the rigid portion and collapsed within the rigid container, the liner portion is configured to dispense the liquid from the rigid container while pressurized gas from an external source is introduced between the rigid portion and the liner portion, and the adhesive bond strength of the first adhesive contact is less than the adhesive bond strength of the second adhesive contact.

21. The container of claim 20, wherein the container wall further comprises a gas inlet extending through the rigid portion to a point between the rigid portion and the liner portion for allowing gas to enter between the rigid portion and the liner portion.

22. The container of claim 20, wherein the rigid portion comprises at least one barrier layer for reducing permeation of gas.

23. The container of claim 20, wherein the rigid portion comprises at least one barrier layer for reducing permeation of moisture.

24. The container of claim 20, wherein the rigid portion comprises at least one barrier layer for reducing penetration of ultraviolet and visible light.

* * * * *